US009303646B2

(12) United States Patent
Park et al.

(10) Patent No.: US 9,303,646 B2
(45) Date of Patent: Apr. 5, 2016

(54) CROSS FLOW FAN AND AIR CONDITIONER

(71) Applicants: Jeongtaek Park, Seoul (KR); Deok Huh, Seoul (KR); Jaehyuk Jung, Seoul (KR)

(72) Inventors: Jeongtaek Park, Seoul (KR); Deok Huh, Seoul (KR); Jaehyuk Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 613 days.

(21) Appl. No.: 13/679,264

(22) Filed: Nov. 16, 2012

(65) Prior Publication Data

US 2013/0129515 A1 May 23, 2013

(30) Foreign Application Priority Data

Nov. 22, 2011 (KR) ..... 10-2011-0122218

(51) Int. Cl.

| | |
|---|---|
| ***F04D 17/04*** | (2006.01) |
| ***F04D 5/00*** | (2006.01) |
| ***F01D 5/14*** | (2006.01) |
| ***F04D 29/28*** | (2006.01) |
| ***F04D 29/30*** | (2006.01) |
| ***F24F 1/00*** | (2011.01) |

(52) U.S. Cl.

CPC *F04D 5/00* (2013.01); *F01D 5/145* (2013.01); *F04D 17/04* (2013.01); *F04D 29/282* (2013.01); *F04D 29/283* (2013.01); *F04D 29/30* (2013.01); *F24F 1/0022* (2013.01); *F05D 2240/304* (2013.01); *F05D 2240/305* (2013.01)

(58) Field of Classification Search

CPC ..... F04D 5/00; F04D 170/04; F04D 29/282; F04D 29/283; F04D 17/04; F05D 2240/304; F05D 2240/305

USPC ..... 415/178, 228

See application file for complete search history.

(56) References Cited

U.S. PATENT DOCUMENTS

| | | | | |
|---|---|---|---|---|
| 2,495,855 | A * | 1/1950 | Marcoe | 416/178 |
| 4,324,529 | A * | 4/1982 | Nickels | 416/187 |
| 5,064,346 | A * | 11/1991 | Atarashi et al. | 416/178 |
| 5,169,290 | A * | 12/1992 | Chou | 416/236 R |
| 5,564,495 | A * | 10/1996 | Yoshihashi et al. | 165/122 |
| 6,830,436 | B2 * | 12/2004 | Shibata et al. | 416/228 |
| 6,899,515 | B2 * | 5/2005 | Ahn et al. | 415/53.1 |
| 2009/0028719 | A1 | 1/2009 | Teraoka et al. | |

FOREIGN PATENT DOCUMENTS

| | | | |
|---|---|---|---|
| CN | 1323952 | A | 11/2001 |
| CN | 101405506 | A | 4/2009 |
| CN | 1367322 | A | 9/2009 |
| JP | 2001323891 | A | 11/2001 |
| JP | 2005120877 | A | 5/2005 |
| JP | 2007205268 | A | 8/2007 |

OTHER PUBLICATIONS

Chinese Office Action issued on Dec. 3, 2014 in the corresponding Chinese Application No. 201210475435.2.

* cited by examiner

*Primary Examiner* — Ninh H Nguyen
(74) *Attorney, Agent, or Firm* — Dentons US LLP

(57) ABSTRACT

A cross flow fan and an air conditioner including the cross flow fan, where the cross flow fan includes a fixing member, and a plurality of blades fixed to an upper surface of the fixing member and spaced apart from each other in a circumferential direction. one or more of the blades include a protrusion protruding in a downward direction from a surface of the blade.

19 Claims, 10 Drawing Sheets

(a)

(b)

CROSS FLOW FAN AND AIR CONDITIONER

CROSS-REFERENCE TO RELATED APPLICATIONS

The present application claims priority under 35 U.S.C. 119 and 35 U.S.C. 365 to Korean Patent Application No. 10-2011-0122218 (Nov. 22, 2011), which is hereby incorporated by reference in its entirety.

BACKGROUND

The present disclosure relates to a cross flow fan and an air conditioner.

In general, an air conditioner is a device that cools or heats indoor space. The air conditioner includes a compressor compressing refrigerants, a condenser condensing the refrigerants discharged from the compressor, an expander expanding the refrigerants having passed through the condenser, and an evaporator evaporating the refrigerants expanded in the expander.

The condenser and the evaporator in the air conditioner are installed in an outdoor unit or an indoor unit as a heat exchanger for heat exchanging between the refrigerants and outside air. The indoor unit, when installed with the heat exchanger, may include a cross flow fan at one side thereof.

The cross flow fan includes a circular plate and a plurality of blades provided on the circular plate. The cross flow fan serves to discharge induced air in a radial direction. That is, the cross flow fan may induce outside air into the indoor unit to cause the air to exchange heat with refrigerants flowing through the heat exchanger, and discharge the air out of the indoor unit.

However, such a cross flow fan according to the related art generates vortexes in the stream of air being discharged due to the blades that are rotating, and this may cause noise and vibration to be generated by the cross flow fan to the indoor space, thereby bringing about inconvenience to a user. Also, the vortexes may degrade efficiency in inducing and discharging air, resulting in deterioration in overall performance of the air conditioner.

SUMMARY

Embodiments provide a cross flow fan and an air conditioner, capable of achieving a reduction in noise and an improvement in discharge efficiency by having a protrusion at one end of a blade.

In one embodiment, a cross flow fan includes a fixing member; and a plurality of blades fixed to an upper surface of the fixing member and spaced apart from each other in a circumferential direction, wherein one or more of the blades have a protrusion at one end portion thereof, the protrusion protruding in a downward direction from a surface of the blade.

In another embodiment, an air conditioner includes a heat exchanger provided inside a case; a cross flow fan disposed at one side of the heat exchanger, the cross flow fan including a plurality of blades; and a flow path guide disposed in the vicinity of an outer circumferential surface of the cross flow fan, wherein an outer edge portion of one or more of the blades include a protrusion protruding in a downward direction from a surface of the blade.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Hereinafter, a cross flow fan and an air conditioner according to the embodiments will be described with reference to the accompanying drawings.

Figure 1:
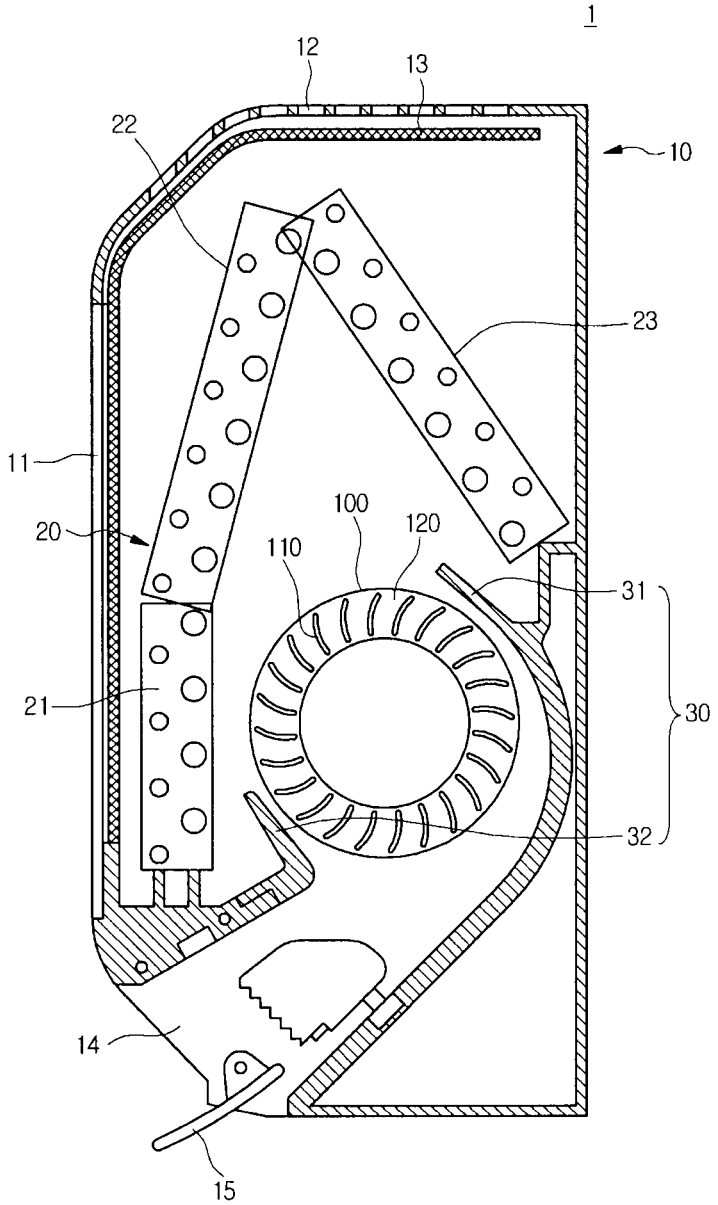
FIG. 1 is a cross-sectional view illustrating an air conditioner according to a first embodiment.

FIG. 1 is a cross-sectional view illustrating an air conditioner according to a first embodiment.

Referring to FIG. 1, an air conditioner 1 according to the first embodiment includes a case 10, a heat exchanger 20, a fan 100, and a flow path guide 30. In this case, this part of the air conditioner 1 may be referred to as an indoor unit.

The case 10 may include a front intake part 11 at its front side, and an upper intake part 12 at an upper side thereof. The front intake part 11 and the upper intake part 12 may be provided with a filter 13 for filtering induced air. The filter 13 may be disposed at the front and upper sides of the case 10 so as to cover the front intake part 11 and the upper intake part 12. In this case, the filter 13 may be fixedly or detachably mounted at the front side of the case 10.

Furthermore, the case 10 may include an air discharge part 14 at its lower side. The air discharge part 14 may be provided with a discharge louver 15 which can control the direction in which air is discharged. When the air conditioner 1 stops, the discharge louver 15 may be controlled to close the air discharge part 14.

The heat exchanger 20 is disposed inside the case 10 and serves for heat exchange between outside air and refrigerants. The heat exchanger 20 may be a fin-tube heat exchanger that includes a refrigerant tube in which refrigerants flow, and a plurality of heat exchange fins through which the refrigerant tube passes.

The heat exchanger 20 is disposed to surround the intake side of the fan 100. For example, the heat exchanger 20 includes a plurality of heat exchange parts 21, 22 and 23 arranged in bent fashion. The heat exchange parts 21, 22 and 23 are disposed to surround the intake side of the fan 100. Accordingly, in this embodiment, a heat exchanger 20 with a relatively large size, which is bent in multiple places, can be installed in a space provided by the indoor unit, thus increasing heat-exchange capacity. Of course, the heat exchanger 20 may be formed as a single bent body.

The air induced through the front and upper intake parts 11 and 12 flows through the heat exchanger 20. In detail, the air induced into the case 10 can be cooled or heated through heat exchange with refrigerants, flowing along the refrigerant tube, while passing through the heat exchange parts 21, 22 and 23. Thereafter, the cooled or heated air is discharged into the indoor space through the air discharge part 14 to thereby create an indoor environment desired by a user.

The fan 100 is disposed at one side of the heat exchanger 20. The fan 100 may be a cross flow fan 100 that discharges radially induced air in the radial direction.

The cross flow fan 100 is formed by coupling a plurality of fan units (not shown) in a length direction. Each of the fan units includes a fixing member 120 having a disk shape, and a plurality of blades 110 fixed to the upper surface of the fixing member 120 and spaced apart from each other in a circumferential direction. That is, the cross flow fan 100 is formed with the plurality of blades 110 arranged in the circumferential direction. The blades 110 of the cross flow fan 100 will be described later in detail.

The flow path guide 30 is disposed in the vicinity of the outer circumferential surface of the cross flow fan 100, and guides the flow of air. That is, the flow path guide 30 guides smooth air intake and discharge of the cross flow fan 100. The flow path guide 30 may include a rear guide 31 and a stabilizer 32.

The rear guide 31 extends from the rear side of the case 10 toward the intake side of the cross flow fan 100. Such a rear guide 31 allows induced air to be smoothly guided toward the cross flow fan 100 which is in rotation. Also, the rear guide 31 can minimize the separation of air, flowing by the cross flow fan 100, from the cross flow fan 100.

The stabilizer 32 is disposed at the discharge side of the cross flow fan 100. The stabilizer 32 is spaced apart from the outer circumferential surface of the cross flow fan 100 so as to prevent air discharged from the cross flow fan 100 from flowing back toward the heat exchanger 20.

The rear guide 31 and the stabilizer 32 are disposed along the length direction of the cross flow fan 100. Also, the rear guide 31 and the stabilizer 32 are spaced apart from the outer circumferential surface of the cross flow fan 100 at a predetermined distance.

When the cross flow fan 100 rotates, air is induced through the front and upper intake parts 11 and 12, and the induced air is subjected to heat exchange with refrigerants that are passing through the heat exchanger 20, and then flows toward the cross flow fan 100. In this case, the air can be smoothly induced by the rear guide 31.

Thereafter, the cross flow fan 100 induces the air to flow from the rear guide 31 side toward the discharge side. In this case, the stabilizer 32 prevents the air discharged from the cross flow fan 100 from being introduced toward the heat exchanger 20 side, so that the air of the air discharge part 14 can be smoothly discharged to the indoor space.

Figure 2:
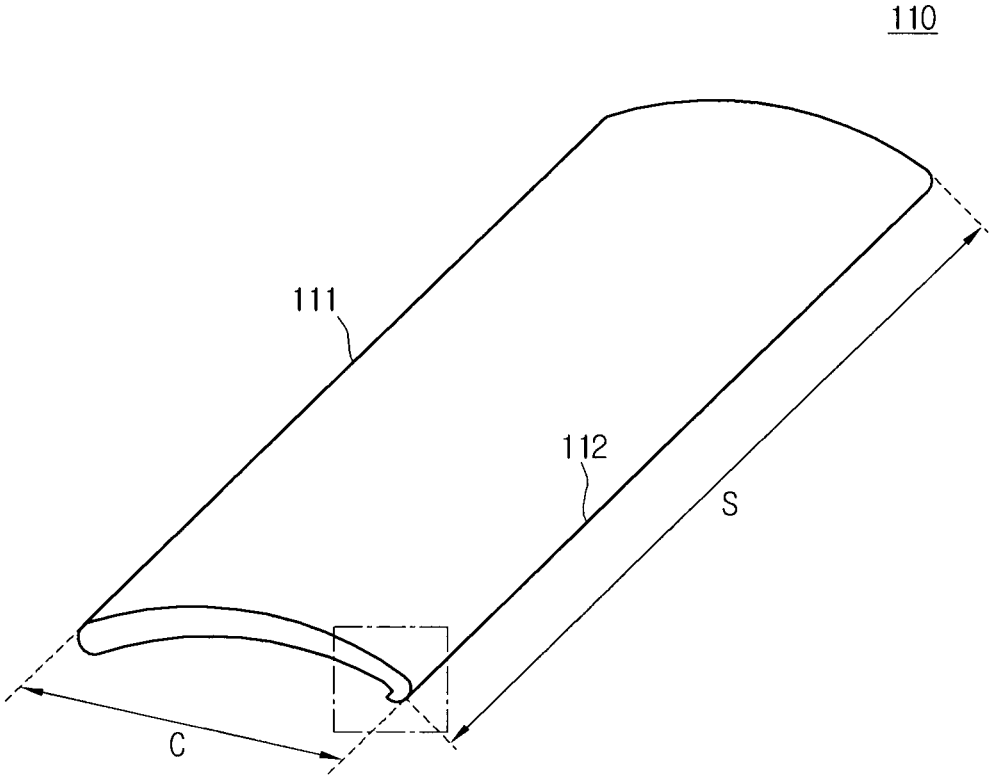
FIG. 2 is a perspective view illustrating a blade according to the first embodiment.
Figure 3:
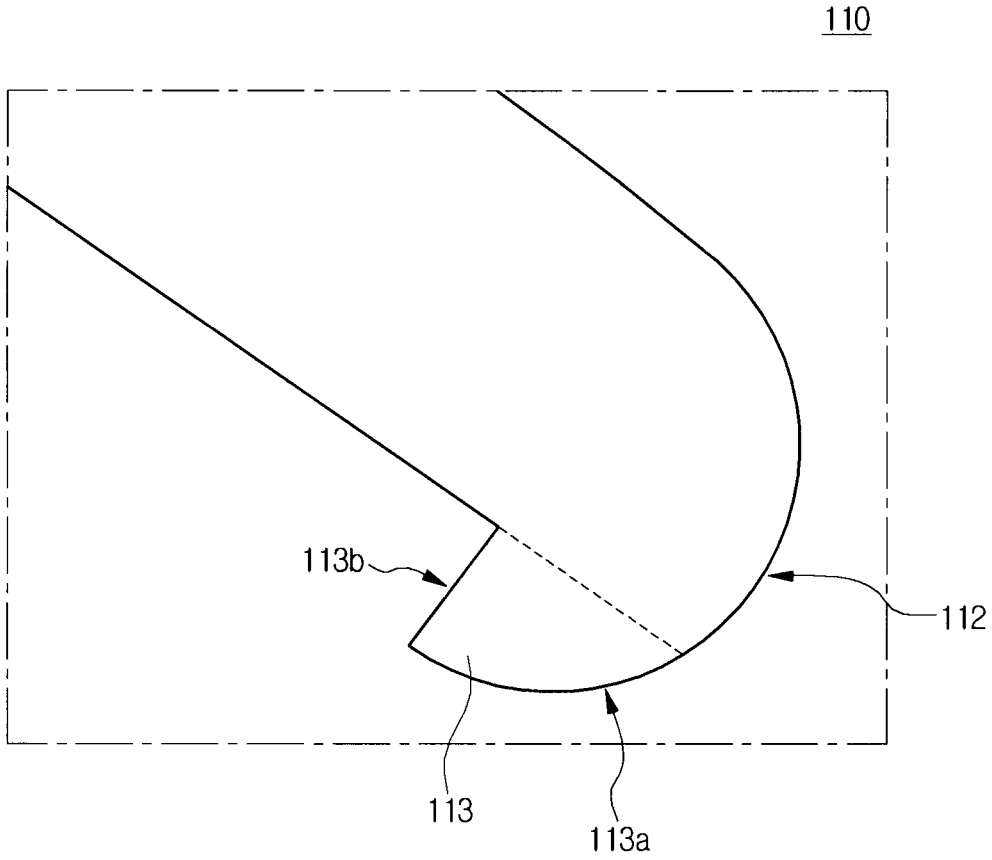
FIG. 3 is a partially enlarged view of FIG. 2.

FIG. 2 is a perspective view illustrating a blade according to the first embodiment, and FIG. 3 is a partially enlarged view of FIG. 2.

Referring to FIGS. 2 and 3, in the blade 110 of the cross flow fan 100 according to the first embodiment, a line extending in the length direction of each blade 110 is defined as a span S, and the height of the blade 110 which is perpendicular to the span S is defined as a chord C. Also, the inner end along the length (span S) direction of the blade 110 is defined as an inner edge 111, and an outer end along the length (span S) direction of the blade 110 is defined as an outer edge 112.

When the blade 110 is installed at the cross flow fan 100, the inner edge 111 faces inwardly of the cross flow fan 100 while the outer edge 112 faces outwardly of the cross flow fan 100. In this case, the inner edge 111 and the outer edge 112 may each have a rounded section. Also, the inner edge 111 of the blade 110 may be disposed parallel or substantially parallel to the rotation axis of the cross flow fan 100.

Furthermore, the blade 110 may have a difference in thickness between the inner edge 111 and the outer edge 112. That is, the blade 110 may be provided such that the thickness thereof gradually decreases from the inner edge 111 toward the outer edge 112.

Each blade 110 has a protrusion 113 at one end, the protrusion 113 protruding from a lower surface of the blade 110, that is, in a downward direction. The protrusion 113 may reduce the generation of vortexes when air is discharged. The protrusion 113 may be provided at the outer edge 112 of the blade 110, and may extend in the length direction of the blade 110.

In this case, the sum of the thickness of the outer edge 112 and the protrusion thickness of the protrusion 113 may be equal to the thickness of the inner edge 111. This is to make the intake and discharge of the air smooth.

When air passing through the center of the cross flow fan 100 flows along the lower surface of the blade 110, vortexes may be generated in the stream of air between the flow path guide 30 and the blade 110. In this case, the protrusion 113 provided at the blade 110 divides the vortexes into small pieces and thus may prevent irregular air flow caused by the vortexes. Accordingly, the blade 110 allows the air induced through the front and upper intake parts 11 and 12 to be smoothly discharged along the air discharge part 14, and may increase the discharge flow rate.

In this case, the outer surface 113*a* of the protrusion 113 facing outwardly of the cross flow fan 100 may be smoothly connected to the outer edge 112 surface of the blade 110. That is, the outer surface 113*a* of the protrusion 113 may be connected to the outer edge 112 surface of the blade 110 in the form of a curved surface. This is to prevent the intake flow rate from being lowered by the protrusion 113 when air is induced through the outer surface 113*a* of the protrusion 113.

Meanwhile, the inner surface 113*b* of the protrusion 113 facing inwardly of the cross flow fan 100 may be in the form of a flat plane inclined with respect to the lower surface of the blade 110 at a predetermined angle. The predetermined angle may be any angle that provides for a desired effect. In this case, an angle defined by the inner surface 113*b* of the protrusion 113 and the lower surface of the cross flow fan 100 may be an acute angle.

In the case where the inner surface 113*b* of the protrusion 113 has the aforementioned form, vortexes may be generated in the space between the lower surface of the blade 110 and the protrusion 113 when air is induced along the outer edge 112 of the blade 110. Of course, when air is discharged, the protrusion 113 may serve to reduce vortexes. That is, the protrusion 113 may reduce vortexes in the air being discharged while generating them in the air being induced. However, since the discharge speed of the air is higher than its intake speed, the overall efficiency may be sufficiently increased by adjusting vortexes generated in the discharge area although vortexes are generated in the intake area.

Figure 4:
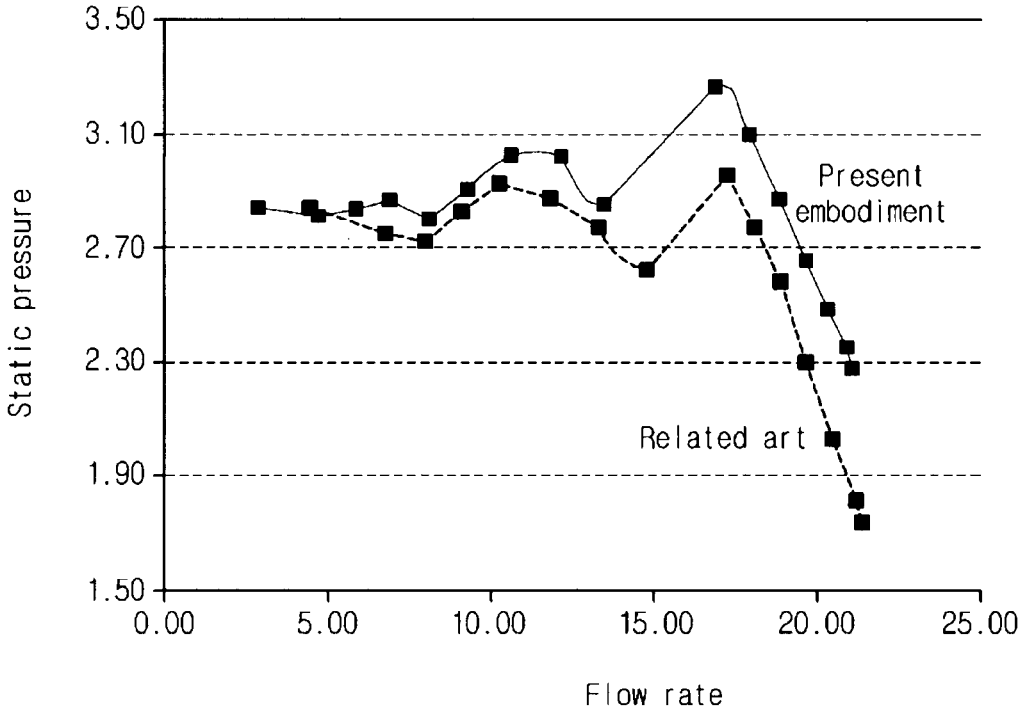
FIG. 4 is a graph illustrating performance comparison between cross flow fans according to the first embodiment and the related art.

FIG. 4 is a view showing a graph illustrating performance comparison between cross flow fans according to the first embodiment and the related art. In FIG. 4, the vertical coordinates represent flow rates, and the horizontal coordinates represent static pressure. The related art, which is a comparative example, is associated with a cross flow fan using a blade without the protrusion 113. In FIG. 4, the driving RPM of this embodiment is equal to that of the related art, and the cross flow fan according to this embodiment is indicated using a solid line, and the related art is indicated using a dotted line.

Referring to FIG. 4, as compared to the related art, the cross flow fan 100 according the first embodiment shows higher static pressure at the same flow rate, and shows a higher flow rate at the same static pressure. That is, as compared to the related art, the present embodiment can achieve an overall improvement in flow rate and static pressure performance by using the protrusion 113 to control vortexes in the discharge area.

Figure 5:
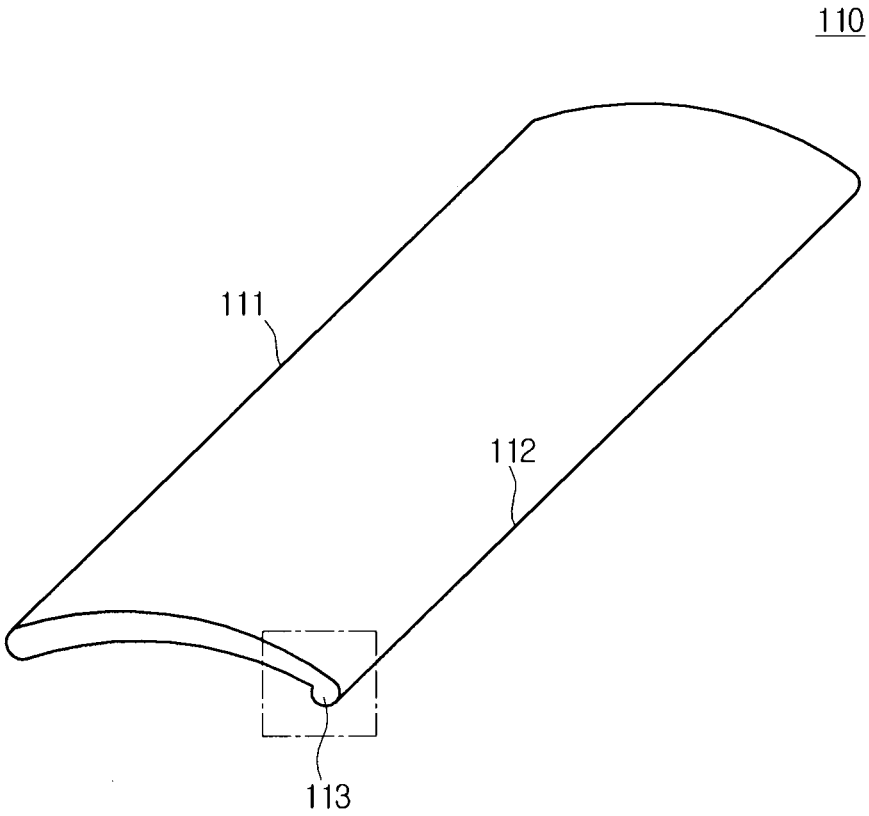
FIG. 5 is a perspective view illustrating a blade according to a second embodiment.
Figure 6:
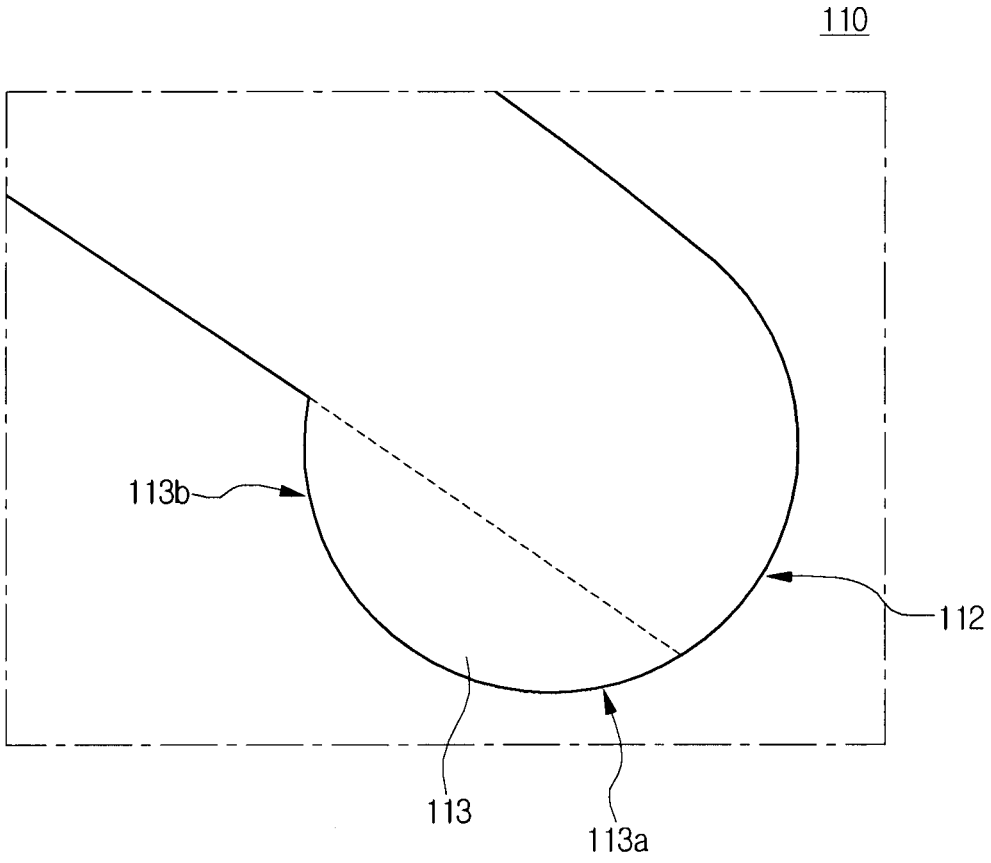
FIG. 6 is a partially enlarged view of FIG. 5.

FIG. 5 is a perspective view illustrating a blade according to a second embodiment, and FIG. 6 is a partially enlarged view of FIG. 5.

Referring to FIGS. 5 and 6, the blade 110 according to the second embodiment may include a protrusion 113 protruding downwardly from the outer edge 112 of the blade 110 as in the first embodiment. However, unlike the first embodiment, the protrusion 113 according to the second embodiment may be curved protrusion protruding downwardly of the blade 110. This is to reduce the generation of vortexes in the intake area.

Of course, as in the first embodiment, the outer surface 113*a* of the protrusion 113 may be connected to the outer edge 112 of the blade 110 in the form of a curved surface. In this embodiment, both the inner and outer surfaces 113*b* and 113*a* of the protrusion 113 are provided in the form of a curved surface protruding in the downward direction. In this case, the effect of dividing vortexes in the discharge area is lowered as compared to the first embodiment; however, the amount of vortexes generated in the intake area may be reduced.

Figure 7:
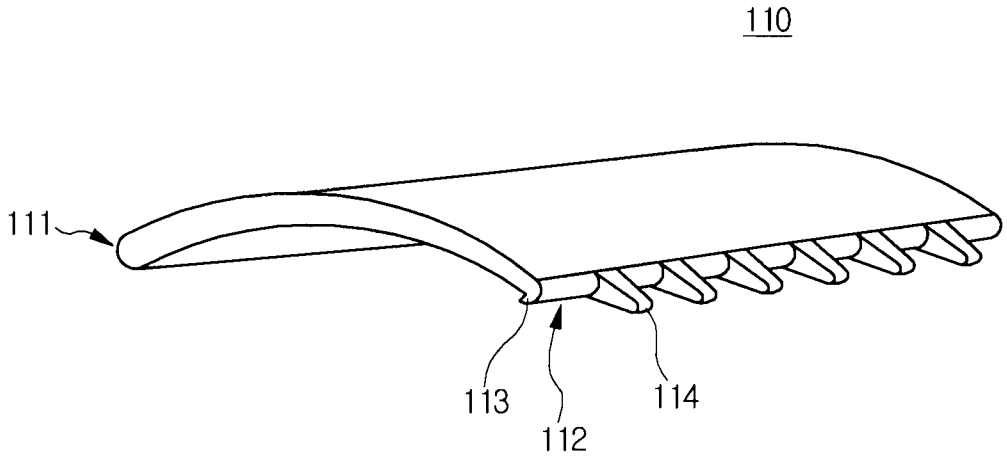
FIG. 7 is a perspective view illustrating a blade according to a third embodiment.
Figure 8:
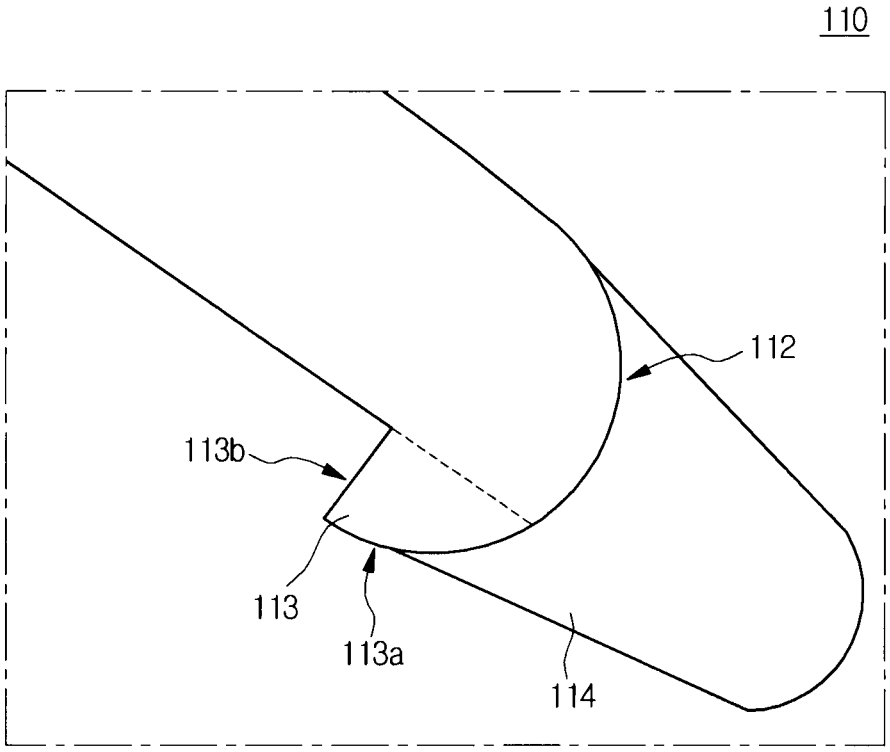
FIG. 8 is a partially enlarged view of FIG. 7.

FIG. 7 is a perspective view of a blade according to a third embodiment, and FIG. 8 is a partially enlarged view of FIG. 7.

Referring to FIGS. 7 and 8, the outer edge of each blade according to the third embodiment may include the protrusion 113 protruding in the downward direction, and a plurality of projections 114 protruding outwardly of the cross flow fan 100. In this case, as shown in the drawing, the protrusion 113 may be provided in the shape depicted in the first embodiment, but the present embodiment is not intended to limit the shape of the protrusion 113 as above.

The projections 114 may reduce noise and increase flow rates by reducing the strength of vortexes in the stream of air being discharged from the cross flow fan 100. The plurality of projections 114 may be spaced apart from each other at a predetermined distance in the length direction of the blade 110.

In this case, the tip of each of the projections 114 may be curved. This is to prevent air resistance caused by the projections 114.

The projections 114 may each have a square or rectangular shape when viewed from the upper or lower surface of the blade 110. In detail, the projections 114 may each have a trapezoid shape tapered toward the end portion thereof. The shape of the projections is to not to interrupt the stream of air being introduced to the cross flow fan 100. Also, the projections 114 may have a thickness that decreases in the direction towards the end portion.

The thickness of each projection 114 at an end attached to the blade 110 is equal to or greater than the thickness in the vicinity of the outer edge 112, and may be smaller than or equal to the sum of the thickness in the vicinity of the outer edge 112 and the protrusion thickness of the protrusion 113. In this case, the thickness in the vicinity of the outer edge 112 refers to a thickness of a portion spaced apart from the outer edge 112 at a predetermined distance in an inward direction of the cross flow fan 100.

In this embodiment, since the protrusion 113 is provided on the lower surface of the blade 110, the outer edge 110 of the blade 110 may be thicker than the related art blade 110. Here, since the projection 114 may be coupled to the outer edge 112 and the protrusion 113, the thickness of the projection 114 may thicker than the thickness in the vicinity of the outer edge 112 by the thickness of the protrusion 113. That is, in this embodiment, the coupling strength of the projection 114 may be enhanced by expanding the coupling area between the projection 114 and the blade 110 by the use of the protrusion 113.

Figure 9:
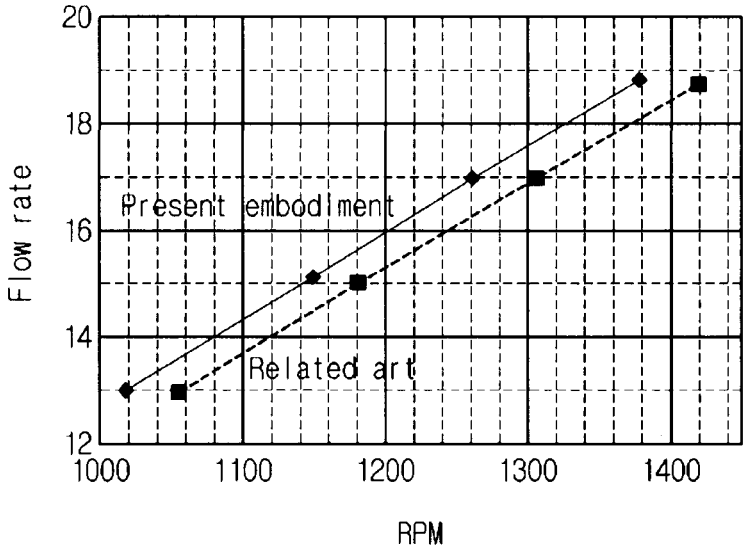
FIGS. 9A and 9B are graphs illustrating performance comparison between cross flow fans according to the third embodiment and the related art.
Figure 9:
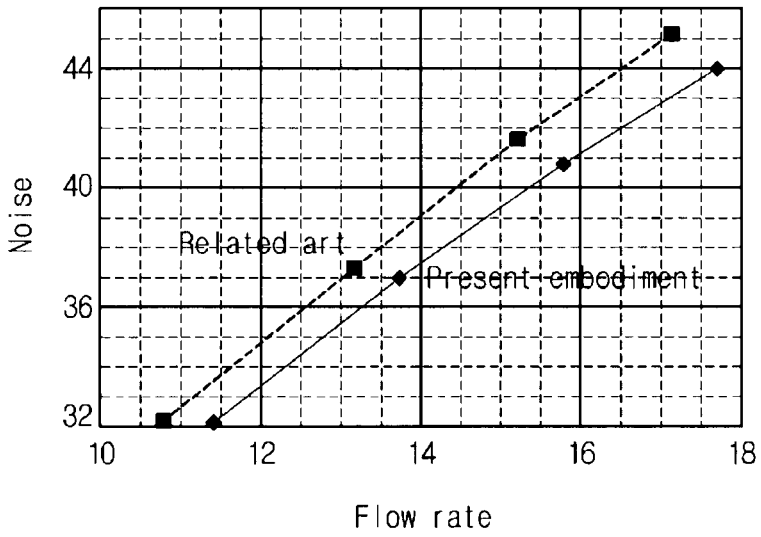

FIGS. 9A and 9B are graphs illustrating performance comparison between cross flow fans according to the third embodiment and the related art. In FIG. 9A, the vertical coordinates represent RPM of a motor driving a fan, and the horizontal coordinates represent flow rates. In FIG. 9B, the vertical coordinates represent flow rates, and the horizontal coordinates represent noise. In FIG. 9B, the driving RPM of the related art is equal to that of this embodiment. Also, the related art in FIG. 9 is associated with a cross flow fan 100 using a blade 110 without any protrusion 113 or projection 114 as in FIG. 4. In FIGS. 9A and 9B, the present embodiment is indicated using a solid line, and the related art is indicated using a dotted line.

Referring to FIGS. 9A and 9B, the cross flow fan 100 according to the third embodiment may ensure higher flow rates than the related art when driven at the same RPM. This means that lower RPM than that of the related art is sufficient to ensure a certain flow rate. Accordingly, the present embodiment may achieve a reduction in power consumption by approximately 5%.

Also, when compared to the related art, this embodiment may achieve a reduction in noise generation when the same flow rate is ensured. Accordingly, when air is induced and discharged at a predetermined flow rate, the present embodiment may increase a user's satisfaction because noise generation in air flow is reduced.

Figure 10:
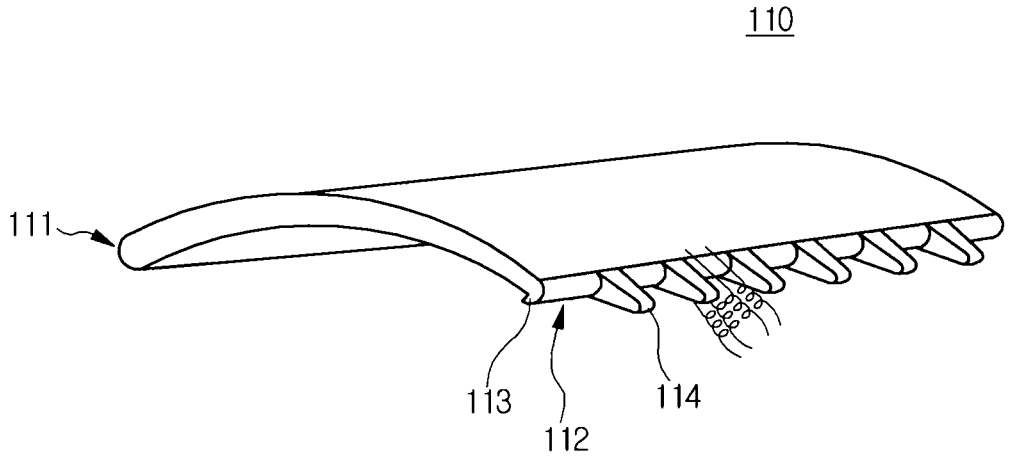
FIG. 10 is a view illustrating a flow of air on a blade according to the third embodiment.

FIG. 10 is a view illustrating a flow of air on a blade according to the third embodiment.

Referring to FIG. 10, when air flows on the blade 110 according to the third embodiment, a plurality of vortexes which flow along the upper surface of the blade can be created in span direction, and also a plurality of vortexes which flow along the projection can be created in span direction. In this case, the vortexes which flow along the upper space may rotate in opposite direction of that of the vortexes which flow the along the projection, such that the vortexes can offset each other. Therefore, the present embodiment may reduce the total strength of the vortexes, and also improve flow rate of air and reduce noise.

As set forth herein, according to the embodiments, a protrusion protruding from the outer edge of a blade in a downward direction of the blade may reduce the generation of vortexes and increases the flow rate of the air being discharged, thus enhancing efficiency of a cross flow fan.

According to the embodiments, one surface of the protrusion facing outside the cross flow fan is formed as a curved surface, so that a reduction in an intake flow rate may be prevented when air is induced by the blade.

Furthermore, according to the embodiments, the outer edge of the blade is provided with a plurality of projections to thereby reduce the strength of vortexes in an air discharge area, and the projections are coupled to the outer edge and the protrusion of the blade so as to ensure a sufficient thickness of the projections, thus having enhanced durability.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cross flow fan, comprising:

a fixing member; and a plurality of blades fixed to an upper surface of the fixing member and spaced apart from each other in a circumferential direction;

a plurality of projections protruding in an outward direction of the cross flow fan, and wherein one or more of the blades have a protrusion at one end portion thereof, the protrusion protruding in a downward direction from a surface of the blade, and wherein an end portion of one or more of the projections is in a form of a curved surface, wherein an inner surface of the protrusion facing inwardly of the cross flow fan is in a form of a flat surface inclined with respect to a lower surface of the blade at a predetermined angle.

2. The cross flow fan according to claim 1, wherein the protrusion extends in a length direction of the one or more blades.

3. The cross flow fan according to claim 1, wherein the protrusion protrudes from an outer edge of the blade.

4. The cross flow fan according to claim 1, wherein an outer surface of the protrusion facing outwardly of the cross flow fan is smoothly connected to an outer edge surface of the blade.

5. The cross flow fan according to claim 4, wherein the outer surface of the protrusion is connected to the outer edge surface of the blade in the form of a curved surface.

6. The cross flow fan according to claim 1, wherein an angle defined by the inner surface of the protrusion and the lower surface of the cross flow fan is an acute angle.

7. The cross flow fan according to claim 1, wherein the protrusion is in the form of a curved shape protruding in the downward direction from a surface of the blade.

8. The cross flow fan according to claim 1, wherein the blade has a thickness that decreases in a direction from an inner edge toward an outer edge.

9. The cross flow fan according to claim 8, wherein the inner edge has a thickness equal to the sum of a thickness of the outer edge and a protrusion thickness of the protrusion.

10. A cross flow fan, comprising:

a fixing member;

a plurality of blades fixed to an upper surface of the fixing member and spaced apart from each other in a circumferential direction;

a plurality of projections protruding in an outward direction of the cross flow fan, wherein an outer edge portion of one or more of the blades include a protrusion protruding in a downward direction from a surface of the blade, and wherein an end portion of one or more of the projections is in a form of a curved surface, wherein the one or more blades has a thickness that decreases in a direction from an inner edge toward an outer edge.

11. The cross flow fan according to claim 10, wherein the protrusion extends in a length direction of the blade, and the plurality of projections are spaced apart from each other at a predetermined interval in the length direction of the blade.

12. The cross flow fan according to claim 10, wherein a thickness of the projections attached to the one or more blades is equal or smaller than a sum of a thickness of the outer edge portion of the blade and a thickness of the protrusion.

13. The cross flow fan according to claim 10, wherein the one or more of the projections have a width that decreases in a direction toward an end portion thereof.

14. The cross flow fan according to claim 10, wherein the one or more of the projections have a thickness that decreases in a direction toward an end portion thereof.

15. The cross flow fan according to claim 10, wherein an inner surface of the protrusion facing inwardly of the cross flow fan is in a form of a flat surface inclined with respect to a lower surface of the blade at a predetermined angle.

16. An air conditioner, comprising:

a heat exchanger disposed inside a case;

a cross flow fan disposed at one side of the heat exchanger, the cross flow fan including a plurality of blades;

a flow path guide disposed in the vicinity of an outer circumferential surface of the cross flow fan;

a plurality of projections protruding in an outward direction of the cross flow fan, and wherein an outer edge portion of one or more of the blades include a protrusion protruding in a downward direction from a surface of the blade, and wherein an end portion of one or more of the projections is in a form of a curved surface, wherein an inner surface of the protrusion facing inwardly of the cross flow fan is in a form of a flat surface inclined with respect to a lower surface of the blade at a predetermined angle.

17. The air conditioner according to claim 16, wherein an outer surface of the protrusion facing outwardly of the cross flow fan is connected to an outer edge surface of the blade in the form of a curved surface.

18. The air conditioner according to claim 16, wherein the outer edge portion of the one or more of the blades includes a plurality of projections protruding in an outward direction of the cross flow fan.

19. The air conditioner according to claim 18, wherein each of the projection decreases in width and thickness in a direction toward an end portion thereof.

* * * * *